US005845615A

United States Patent [19]

Nakamura et al.

[11] Patent Number: 5,845,615

[45] Date of Patent: Dec. 8, 1998

[54] VALVE TIMING CONTROL DEVICE

[75] Inventors: Motoo Nakamura, Toyota; Naoki Kira, Anjo; Kazumi Ogawa, Toyota, all of Japan

[73] Assignee: Aisin Seiki Kabushiki Kaisha, Aichi-pref., Japan

[21] Appl. No.: 989,665

[22] Filed: Dec. 12, 1997

[30] Foreign Application Priority Data

Dec. 12, 1996 [JP] Japan ..... 8-332529
Dec. 24, 1996 [JP] Japan ..... 8-344086

[51] Int. Cl.[6] ..... F01L 1/344

[52] U.S. Cl. ..... 123/90.17; 123/90.31; 74/568 R; 464/2

[58] Field of Search ..... 123/90.15, 90.17, 123/90.31; 74/568 R; 464/1, 2, 160

[56] References Cited

U.S. PATENT DOCUMENTS 5,450,825 9/1995 Geyer et al. ..... 123/90.17
5,520,145 5/1996 Nagai et al. ..... 123/90.17
5,666,914 9/1997 Ushida et al. ..... 123/90.17
5,724,929 3/1998 Mikame et al. ..... 123/90.17
5,738,056 4/1998 Mikame et al. ..... 123/90.17

*Primary Examiner*—Weilun Lo
*Attorney, Agent, or Firm*—Hazel & Thomas

[57] ABSTRACT

A valve timing control device includes a rotational shaft for opening and closing a valve, a rotational transmitting member rotatably mounted on the rotational shaft, a vane connected to one of the rotational shaft and the rotational transmitting member, a chamber defined between the rotational shaft and the rotational transmitting member and divided into a first pressure chamber and a second pressure chamber by the vane being extended into the chamber, a fluid supply device for supplying fluid under pressure to at least a selected one of the first pressure chamber and the second pressure chamber, a locking mechanism for connecting the rotational shaft and the rotational transmitting member when the relative phase between the rotational shaft and the rotational transmitting member is in a predetermined phase and a damping mechanism for damping the locking operation of the locking means.

10 Claims, 10 Drawing Sheets

VALVE TIMING CONTROL DEVICE

BACKGROUND OF THE INVENTION

1. Field of the Invention

The present invention relates to a valve timing control device and is particular to a valve timing control device for controlling an angular phase difference between a crank shaft of a combustion engine and a cam shaft of the combustion engine.

2. Description of the Prior Art

In general, a valve timing of a combustion engine is determined by valve mechanisms driven by cam shafts according to a characteristic of the combustion engine or a use of the combustion engine. Since, however, a condition of the combustion is changed in response to the rotational speed of the combustion engine and so on, it is difficult to obtain optimum valve timing through the whole rotational range. Therefore, a valve timing control device which is able to change valve timing in response to the condition of the combustion engine has been proposed as an auxiliary mechanism of the valve mechanism in recent years.

A conventional device of this kind is disclosed, for example, in U.S. Pat. No. 4,858,572. In the foregoing conventional device which in to be referenced with FIGS. 15(A)–15(C), there is fixedly mounted a rotor 2 on a rotational shaft 1 and a rotational transmitting member 3 is rotatably mounted on the rotor 2. A plurality of vanes 4 are connected to an outer periphery of the rotor 2 and are extended into respective pressure chambers 5 defined by an outer periphery of the rotor 2 and an inner side of the rotational transmitting member 3 such that the pressure chambers are arranged along the outer periphery of the rotor 2. Each vane 4 divides the pressure chamber 5 into a first chamber 5*a* and a second chamber 5*b*. The rotational transmitting member 3 is formed therein with a radial retracting hole 6 in which a locking pin 9 and a spring 7 urging the locking pin 8 toward the rotor 2 are accommodated. The rotor 2 is formed therein with a receiving hole 9 in which the locking pin 8 can be received when the receiving hole 9 comes to be in coincidence with the retracting hole 6 in axis as will be explained later. Oil under pressure is supplied and discharged to and from the first chamber 5*a* and the second chamber 5*b* via a passage 10*b* and a passage 10*c*, respectively. In the conventional device, the vane 4 is expected to rotate within the angular extension of the pressure chamber 5 by differentiating the pressures in the first chamber 5*a* and the second chamber 5*b*, which results in an adjustment of the rotor 2 or rotational shaft 1 relative to the rotational transmitting member 3 in phase angle. In the foregoing structure, the passage 10*a* is in fluid communication with the passage 10*b* inside the rotational shaft 1 and is fluidly isolated from the passage 10*c*.

When the rotor 2 is at the most advanced position relative to the rotational transmitting member 3 as shown in FIG. 15(A), as soon as the oil under pressure is supplied to the second chamber 5*b* via the passage 10*c* and the oil under pressure is discharged from the first chamber 5*a* via the passage 10*b*, the vane 4 is brought into the counter-clockwise rotation as indicated with an arrow B due to the pressure difference between the first chamber 5*a* and the second chamber 5*b*. After such a rotation of the rotor 2 through a set angle, the rotor 2 is brought into its most retarded position relative to the rotational transmitting member 3 as shown in FIG. 15(B). Immediately upon establishment of such a condition, the receiving hole 9 aligns with the retracting hole 6 and due to the urging force of the spring 7, the locking pin 8 is brought into engagement with the receiving hole 9. Thus, the relative rotation between the rotor 2 and the rotation is prevented. If advancement of the rotor 2 is desired, as shown in FIG. 15(C), the oil is supplied to the first chamber 5*a* via the passage 10*b* and the oil is discharged from the second chamber 5*b* via the passage 10*c*. Simultaneously, the oil is supplied to the receiving hole 9 via the passage 10*a* and the locking pin 8 is ejected from the receiving hole 9 into the retracting hole 6. Thus, the vane 4 is permitted to rotate in the clockwise direction as indicated with an arrow A in FIG. 15(C).

In the foregoing structure, whenever the rotor 2 takes the most retarded position relative to the rotational transmitting member 3, the locking pin 8 is brought into engagement with the receiving hole 9 and whenever an advance of the rotor 2 relative to the rotation transmitting member 3 is desired, the locking pin 8 is retracted to the retracting hole 9, differentiating the spaces 5*a* and 5*b* in pressure. As mentioned above, the passage 10*a* meets with the passage 10*b* inside the rotational shaft 1. Such a connection is intended for accomplishing two purposes: one is to isolate the passage 10*b* when the rotor 2 is desired to be transferred toward the retarded position in order to establish a smooth receipt of the locking pin 8 into the receiving hole 9 subsequent to the discharge of the oil therefrom immediately when the most retarded position is taken. The other is to establish a quick ejection of the locking pin 8 from the receiving hole 9 and a quick subsequent transfer of the rotor 2 toward the most advanced position by establishing simultaneous oil supply into the receiving hole 9 and the first chamber 5*a*.

However, frequent engagements of the locking pin 8 with the receiving hole 9, each of which occurs whenever the rotor 2 takes the most retarded position relative to the rotational transmitting member 3 is established, lead to that each of the locking pin 8, the receiving hole 9 and the retracting hole 8 have to be of high durability. Thus, manufacturing these members as payable ones are in effect difficult.

In addition, the principal purpose for regulating the phase angle between the rotor 2 (or the rotational shaft 1) and the rotation transmitting member 3 by employing the locking pin 8 is as follows: After the pressure in each of the chambers 5*a* and 5*b* drops when the cessation of an oil pressure source occurs due to the stoppage of the engine for example, even if the engine is re-started, simultaneous raise in pressure in each of chambers 5*a* and 5*b* cannot be established, which allows the vane 4 to rotate freely in the pressure chamber. The resultant vane 4 is brought into engagement with a side wall of the pressure chamber 5 and a collision noise generates. To avoid such a noise generation, the movement of the vane 4 is expected to be restricted in such a manner that the locking pin 8 prevents the relative rotational between the rotor 2 and the rotation transmitting member 3 until the pressure in each of the chambers 5*a* and 5*b* is raised to a sufficient value. It is to be noted that to the contrary while the engine is running the sufficient pressure is filled in either the first chamber 5*a* or the second chamber 5*b* which prevents the free rotation of the vane 4 and therefore the foregoing noise generation fails to occur.

In brief, though the locking pin 8 is an essential element for the valve timing control device, its durability cannot be assured due to frequent engagement and disengagement with the receiving hole 9.

SUMMARY OF THE INVENTION

It is, therefore, an object of the present invention to provide an improved valve timing control device which overcomes the above drawbacks.

It is another object of the present invention to provide an improved valve timing control device which can improve its reliability.

In order to achieve these objectives, there is provided an improved valve timing control device which includes a rotational shaft for opening and closing a valve, a rotational transmitting member rotatably mounted on the rotational shaft, a vane connected to one of the rotational shaft and the rotational transmitting member, a chamber defined between the rotational shaft and the rotational transmitting member and divided into a first pressure chamber and a second pressure chamber by the vane being extended into the chamber, fluid supply means for supplying fluid under pressure to at least a selected one of the first pressure chamber and the second pressure chamber, locking means for connecting the rotational shaft and the rotational transmitting member and damping means for damping the locking operation of the locking means.

BRIEF DESCRIPTION OF THE DRAWINGS

Additional objects and advantages of the present invention will became more apparent from the following detailed description of a preferred embodiment thereof when considered with reference to the attached drawings, in which.

DESCRIPTION OF THE PREFERRED EMBODIMENTS

A valve timing control device in accordance with preferred embodiments of the present invention will be described with reference to attached drawings.

Figure 1:
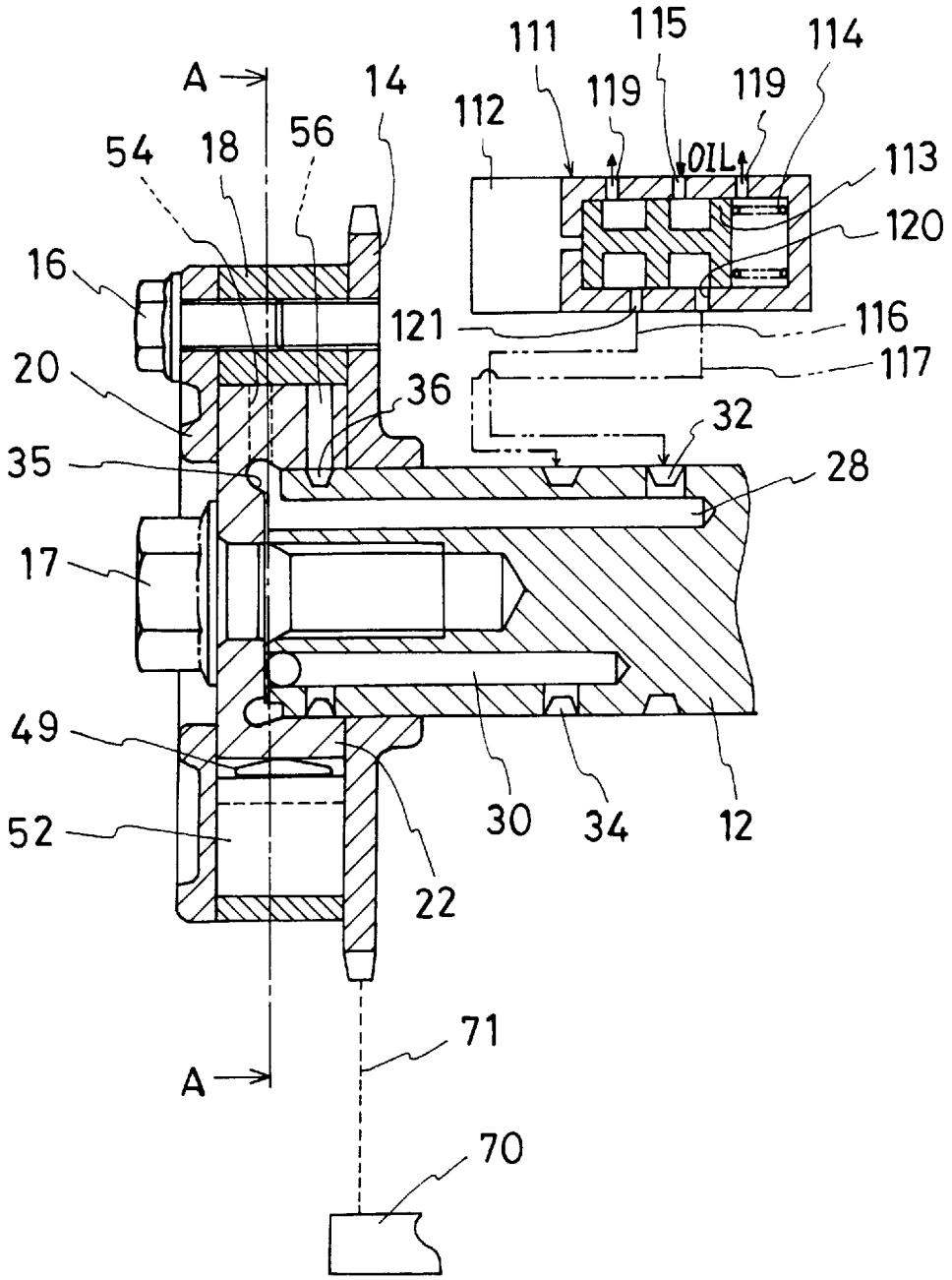
FIG. 1 shows a sectional view of a first embodiment of a valve timing control device in accordance with the present invention.

FIGS. 1 through 6 show a first embodiment of the present invention. Referring to FIG. 1, a cam shaft 12 which corresponds to a part of a rotational shaft of the present invention and which is provided with cam portions (not shown) for opening and closing intake valves (not shown) is rotatably mounted on a cylinder head (not shown) of an engine. A valve timing control device, as will become apparent from the following description, is provided at one end portion of the cam shaft 12. In the valve timing control device which is in the form of the disclosed configuration, a rotational torque is transmitted from a crank shaft 70 via chain 71 to a timing sprocket 14 rotatably mounted on the cam shaft 12. The timing sprocket 14, outer rotor 18 and an outer plate 20 are fastened by bolts 16 so as to prevent a rotation of any one of the members 14, 18 and 20 relative to the other members and these three members 14, 19 and 20 correspond to a rotational transmitting member of the present invention.

Inside the outer rotor 18 which is formed into a cylindrical configuration, is an inner rotor 22 is fixedly mounted on one end portion of the cam shaft 12 by means of a bolt 17. Thus, a relative movement or rotation between the inner rotor 22 constituting the rotational shaft of the present invention together with the cam shaft 12 and the rotational transmitting member is expected to be established between an outer circumference periphery of the inner rotor 22 and an inner circumference periphery of the outer rotor 18.

In the cam shaft 12, there are formed a first passage 28 and a second passage 30 which are extended in the axial direction. One end of the first passage 28 and one end of the second passage 30 are in fluid communication with circular grooves 35 and 36 which are formed on the outer circumference periphery of the cam shaft 12, respectively. The other end of the first passage 28 and the other end of the second passage 30 are in fluid communication with circular grooves 32 and 34 which are formed on the outer circumference periphery of the cam shaft 12, respectively. The grooves 32 and 34 communicate with connecting ports 121 and 120 of the switching valve 111 via passages 116 and 117, respectively. Oil is expected to be supplied from an oil pump (not shown) driven by the engine to either the groove 32 or the groove 34 exclusively via the switching valve 111. Instead of the oil, other liquid or gas such as air is available.

The switching valve 111 is constructed in such a manner that when a solenoid 112 is energized, a spool 113 is moved against an urging force of a spring 114 in the rightward direction. While the spool 114 remains in the illustrated condition in which the solenoid 112 is not energized, the switching valve 111 establishes fluid communication between the connecting port 120 and a supply port 115 which communicates with the oil pump as well as establishes a fluid communication between the connecting port 121 and a drain port 119. When the solenoid 112 is energized, the switching valve 111 establishes a fluid communication between the connecting port 120 and a drain port 119 as well as establishes a fluid communication between the connecting port 121 and the supply port 115. Thus, the oil is supplied to the first passage 28 while the solenoid 112 is energized and the oil is supplied to the second passage 30 while the solenoid 113 is not energized.

Figure 2:
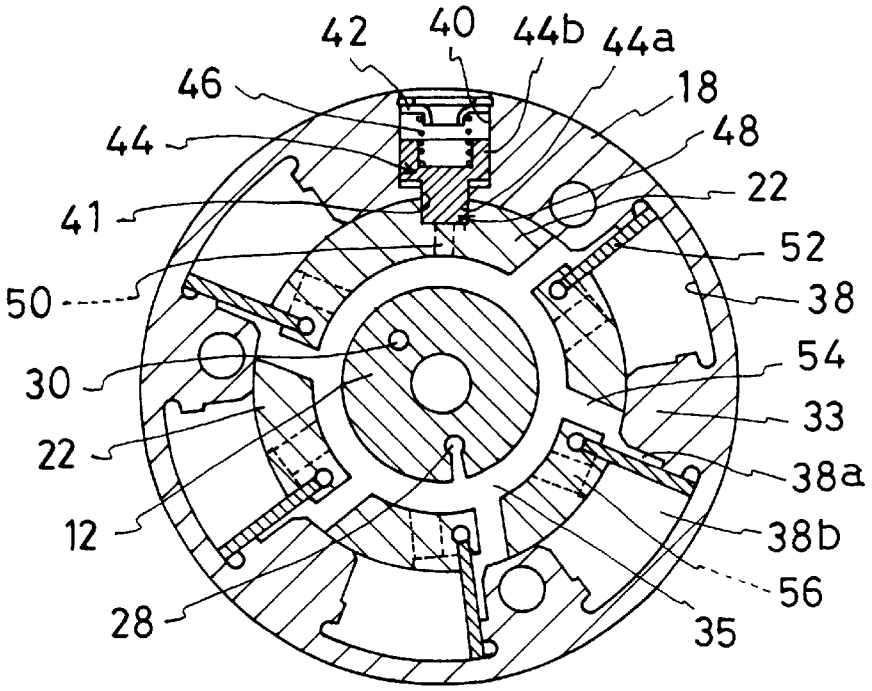
FIG. 2 shows a cross-sectional view taken on line A—A of FIG. 1.

As shown in FIG. 2, at the inner circumference surface of the outer rotor 18 there are formed five pressure chambers 38 each of which is defined by two adjacent partition walls 33 in the circumferential direction, and a sole retracting hole 40 which penetrates in the radial direction. Each pressure chamber 38 is defined by the outer plate 20 and the timing sprocket 14 in the axial direction and is defined by the outer rotor 18 and the inner rotor 22 in the radial direction. Each pressure chamber 38 is divided into a first pressure chamber 38*a* and a second pressure chamber 38*b* by a vane 52. Each vane 52 is mounted into a groove formed on the outer circumference of the inner rotor 22 such that the vane 52 extends outwardly along the radial direction of the inner rotor 22, and is received in the pressure chamber 38. Each vane 52 is urged outwardly by a spring 49 which is disposed at the bottom portion of the groove of the inner rotor 22 (FIG. 1) so as to be in sliding engagement with a bottom of the pressure chamber 38. Each first pressure chamber 38*a* is in fluid communication with the groove 35 through a passage 54 formed in the inner rotor 22. Each second pressure chamber 38*b* is in fluid communication with the groove 36 through a passage 56 formed in the inner rotor 22.

The retracting hole 40 formed in the outer rotor 18 has a stepped configuration and is provided with a small opening portion 41 at inner portion thereof in the radial direction. An outer opening end of the retracting hole 40 whose diameter in larger than that of the small opening portion 41 is covered with or sealed by a retainer 42 having at outer portion thereof an air brooder. A locking pin 44 is slidably fitted into the retracting hole 40 and the small opening portion 41. The locking pin 44 has a stepped configuration and is provided with a large diameter portion 44*b* which is slidably fitted into the retracting hole 40 and a small diameter portion 44*a* which is validably fitted into the small opening portion 41. The diameter of the small diameter portion 44*a* is nearly equal to that of the small opening portion 41. A spring 46 is disposed between the retainer 42 and the large diameter portion 44*b* of the locking pin 44 and thereby the locking pin 44 is normally urged toward the inner rotor 22.

In the outer peripheral surface of the inner rotor 22, there is formed a receiving hole 48 whose diameter is equal to that of small opening portion 41 of the retracting hole 40 so that the small diameter portion 44*a* of the locking pin 44 can be fitted into the receiving hole 48. At a central portion of a bottom of the receiving hole 48, a third passage 50 is formed which extends into a central portion of the inner rotor 22 so as to be in fluid communication with the groove 36. Thus, the third passage 50 comes to be in fluid communication with the second passage 30 and the passage 56 via the groove 36. Thereby, the small diameter portion 44*a* of the locking pin 44 which is fitted into the receiving hole 49 can be ejected or excluded outside the receiving hole 48 against the urging force of the spring 46 when the oil under pressure is supplied to the receiving hole 48 via the second passage 30 and the third passage 50.

In this embodiment, the maximum retarded condition is expected to be established between a phase angle of the cam shaft 12 and a phase angle of the outer rotor 18 when the receiving hole 48 and the retracting hole 40 are in phase. In other words, as shown in FIG. 2, when the vane 52 minimizes the volume of the first pressure chamber 38*a* to which the oil under pressure is supplied during phase advance, the receiving hole 48 is in alignment with the retracting hole 40.

Figure 3A:
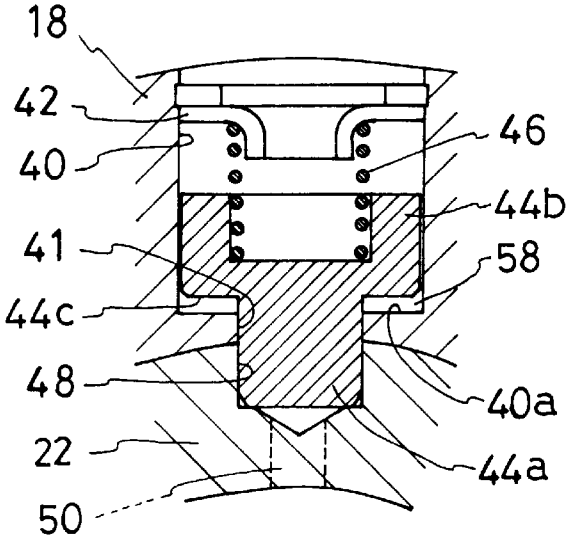
FIG. 3A shows an enlarged view of a principal portion and shows an engaged condition of a locking pin of the valve timing control device shown in FIG. 1.
Figure 3B:
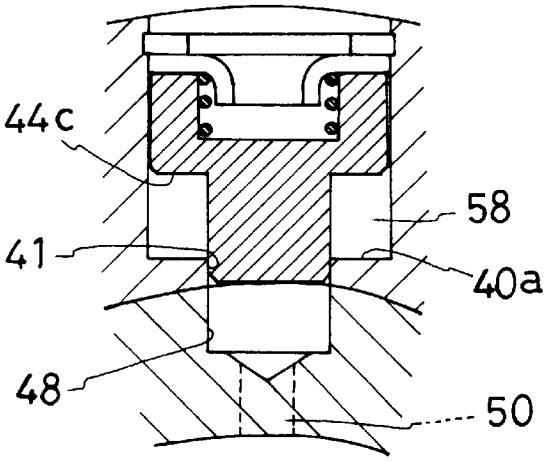
FIG. 3B shows an enlarged view of a principal portion and shows a disengaged condition of a locking pin of the valve timing control device shown in FIG. 1.

In addition, in this embodiment, as shown in FIGS. 3A and 3B, a damping chamber 58 is formed between a stepped portion 44*c* of the locking pin 44 and a stepped portion 40*a* of the retracting hole 40. The large diameter portion 44*b* is slidably fitted into the retracting hole 40 with a slight leaking clearance and the small diameter portion 44*a* is slidably fitted into the small opening portion 41 with a slight leaking clearance. Therefore, the oil under pressure which is supplied to the receiving hole 48 through the passage 50 can be communicated to the damping chamber 58 through the leaking clearance. Thereby, during phase control after the small diameter portion 44*a* of the locking pin 44 fitted into the receiving hole 48 as shown in FIG. 3A is ejected or excluded outside the receiving hole 48 against the urging force of the spring 46, the damping chamber 58 is filled with the oil. Then, when the receiving hole 48 is in alignment with the retracting hole 40 at the maximum retarded condition as shown in FIG. 3B and the spring 46 intends to move the locking pin 44 toward the receiving hole 48, the oil in the damping chamber 58 is slowly leaked into the receiving hole 48 and the retracting hole 40 between the locking pin 44 and the retainer 42 through the leaking clearance and thereby a damping effect is obtained. As a result, the locking operation of the locking pin 44, namely the movement of the locking pin 44 toward the inner rotor 12, is damped by the damping effect due to the damping chamber 58 and the small diameter portion 44*a* of the locking pin 44 is prevented from fitting into the receiving hole 48 when the valve timing control device begins to advance the phase from the maximum retarded condition during the running of the engine.

Figure 4:
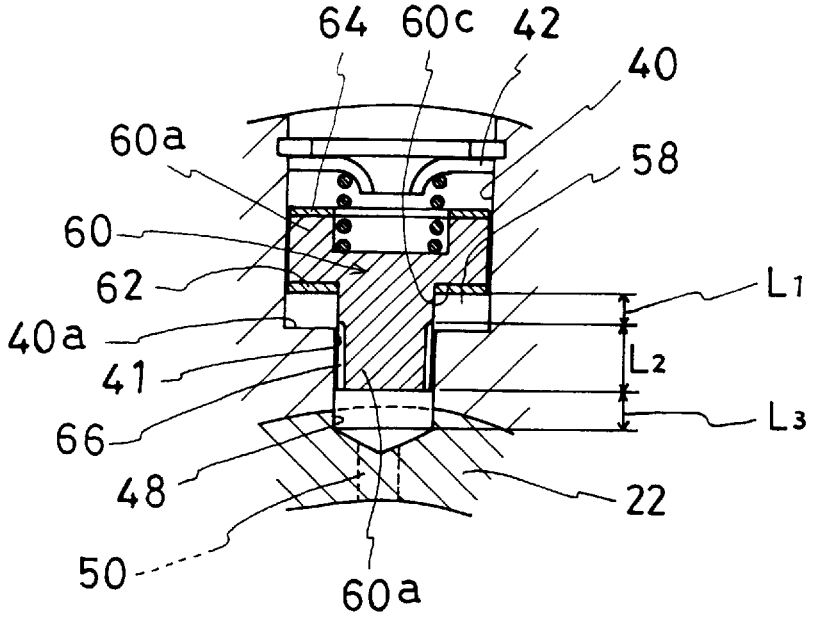
FIG. 4 shows a cross-sectional view of a variation of the locking pin shown in FIGS. 3A and 3B.

FIG. 4 shows a variation of the locking pin of the above first embodiment. A locking pin 60 has a stepped configuration which is provided with a small diameter portion 60*a* and a large diameter portion 60*b*. Cushion members 62 and 64 made of oil-resisting rubber (i.e., NBR), oil-resisting resin and so on are secured to a stepped portion 60*c* of the locking pin 60 and a back surface of the locking pin 60 which is opposed to the retainer 42. When the locking pin 60 is moved toward the inner rotor 22 and the stepped portion 60*c* of the locking pin 60 contacts with the stepped portion 40*a* of the retracting hole 40 as well as when the locking pin 60 is moved outwardly and the back surface of the locking pin 60 contacts with the retainer 42, the generation of the noise is prevented by the cushion members 62 and 64. The cushion members 62 and 64 are not always secured to the locking pin 60, and may be secured to the stepping portion 40*a* of the retracting hole 40 and the retainer 42.

Furthermore, in this variation, axial slits 66 having a axial length L2 are formed on the outer circumferential surface of the small diameter portion 60*a* of the locking pin 60 which is located at the side of its top end. The small diameter portion 60*a* on whose outer circumferential surface the axial slits are not formed and which has an axial length L1 remains at the side of its base portion connected to the large diameter portion 60*b*. The axial length L1 is equal to an axial length L3 between the position of the top and of the small diameter portion 60*a* shown in FIG. 4 and the position of the top end of the small diameter portion 60*a* when the locking pin 60 is moved toward the inner rotor 22 to the utmost limit. Thereby, when the oil under pressure is supplied to the receiving hole 48 after the engine is started and the locking pin 60 is moved outwardly for the length L3, the damping chamber 58 is communicated to the receiving hole 48 through the axial slits 66 and therefore it is prevented that the negative pressure is generated in the damping chamber 58 when the locking pin 60 is moved outwardly just after the engine started. Since this negative pressure acts on the locking pin 60 as a force which urges the locking pin 60 inwardly when the valve timing control device begins to advance the phase from the maximum retarded condition, it is able to prevent the small diameter portion 60*a* of the locking pin 60 from fitting into the receiving hole 48 unnecessarily. Now, in this variation, it is able to easily change the moving speed of the locking pin 60 by changing the depth, length or the number of axial slits 66.

The operation of the valve timing control device having the above structure will now be described.

While the engine is at rest, the oil pump also remains non-operational, which results in that the pressure of the oil drops which is in the first passage 28, the second passage 30, the first pressure chambers 38*a*, the second pressure chambers 38*b*, the third passage 50, the passage 54 and 56. Thus, the locking pin 44 is urged by the spring 46 and is moved into the receiving bore 48, as shown in FIG. 2. Such an insertion of the locking pin 44 into the receiving bore 48 regulates or prevents a relative rotation between the inner rotor 22 and the outer rotor 18. Even though the insertion of the locking pin 44 into the receiving bore 48 is unsuccessful due to an out of phase between the receiving bore 48 and the retracting bore 40 when the engine is at rest, the desired insertion can be established. The reason is that the vane 52 begins to rotate toward the retarded side immediately when the engine starts, such a rotation completes while the oil pressure in each the pressure chambers 38*a* and 38*b* is at a low level for a predetermined time after the engine starts, and as soon as the vane 52 takes the maximum retarded position the receiving bore 48 and the retracting bore 40 become in phase. Thereby, the vanes 52 are prevented from engaging with the side walls of the pressure chambers 38 and collision noise is avoided.

When the engine is started, the solenoid 112 of the switching valve 111 is not energized. Thereby, the oil is supplied to the second passage 30 and is introduced via the passages 56 to the second pressure chambers 38*b*. At the same time, the oil is supplied to the receiving hole 48 via the second passage 30 and the third passage 50. When the pressure of the oil reaches to the predetermined level, the locking pin 44 is ejected outside the receiving hole 48 against the urging force of the spring 46 an shown in FIG. 5 and a relative rotation between the inner rotor 22 and the outer rotor 18 is allowed. In this condition, the oil which is supplied to the receiving hole 48 is supplied to the damping chamber 58 via the leaking clearance between the small diameter portion 44*a* and the small opening portion 41 and the damping chamber 58 is filled with the oil.

Figure 5:
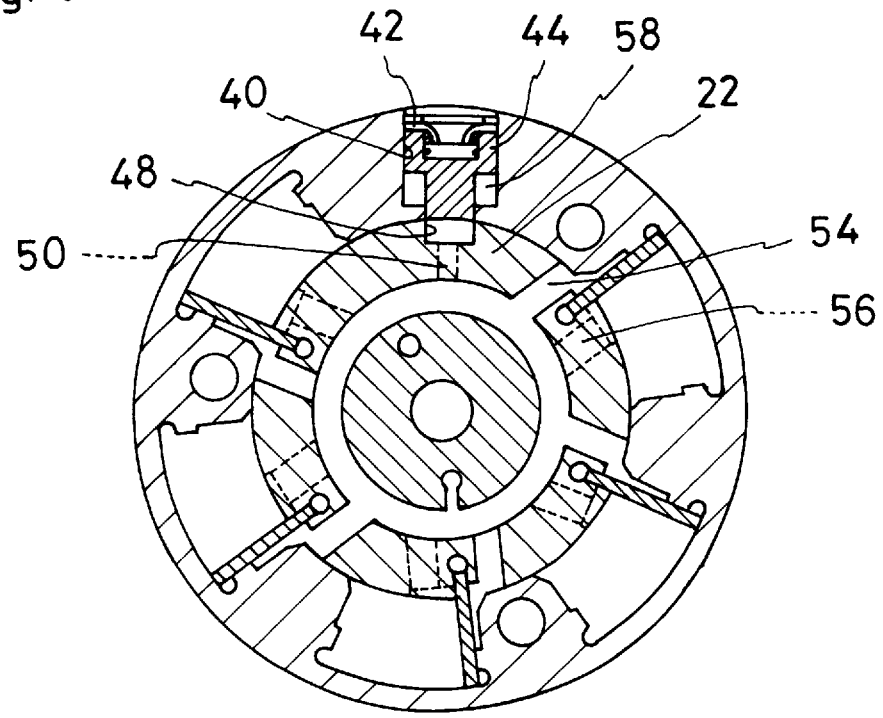
FIG. 5 shows a cross-sectional view taken on line A—A of FIG. 1 and shown a condition which begins to advance from a maximum retarded condition.

If advancing of the phase angle is desired while the inner rotor 22 is at its maximum retarded position as shown in FIG. 5, the solenoid 112 of the switching valve 111 is energized and the oil is supplied into the first passage 28 and is introduced via the passages 54 to the first pressure chambers 38*a*. At this time, the oil is discharged from the second pressure chambers 38*b* and the receiving hole 48. Therefore, the spring 46 intends to move the locking pin 44 toward the receiving hole 48. However, the movement of the locking pin 44 toward the inner rotor 12 is damped by the above mentioned damping effect of the damping chamber 58 and the small diameter portion 44*a* of the locking pin 44 is prevented from fitting into the receiving hole 48. Accordingly, the inner rotor 22, the vanes 52 and the cam shaft 12 begin to rotate toward the advanced side relative to the outer rotor 18 without being regulated the relative rotation between the inner rotor 22 and the outer rotor 18 by the locking pin 44 unnecessarily as shown in FIG. 6 and the angular phase of the inner rotor 22 (=the cam shaft 12) is advanced relative to that of the outer rotor 18 (=the crank shaft 70).

Figure 6:
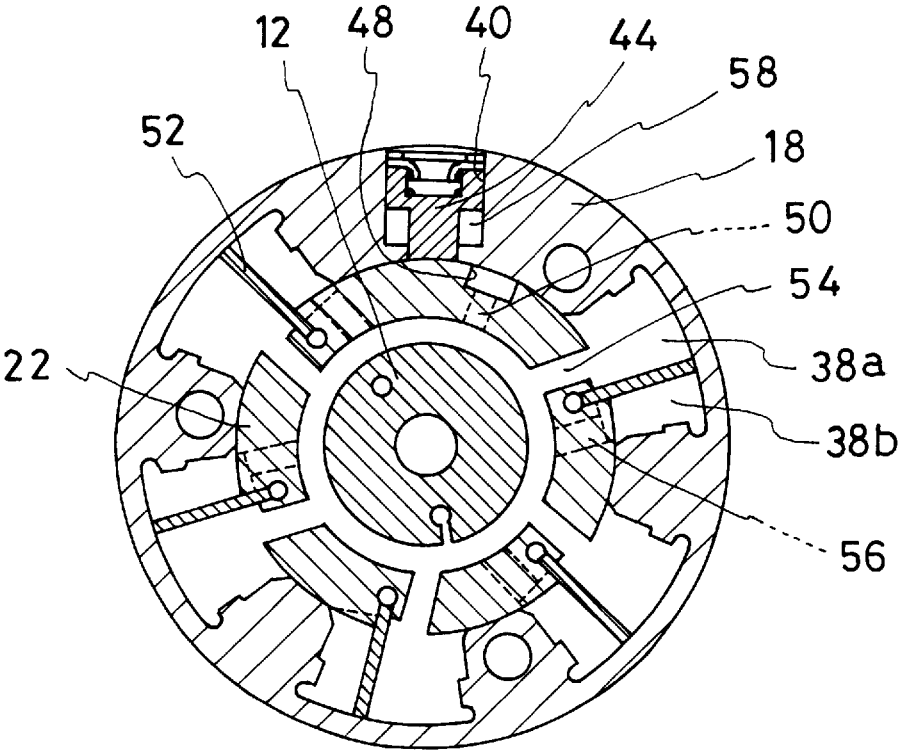
FIG. 6 shows a cross-sectional view taken on line A—A of FIG. 1 and shows a condition which is advanced a little from a maximum retarded condition.

On the other hand, when the relative rotation between the outer rotor 18 and the inner rotor 22 is desired to change from the advanced condition shown in FIG. 6 to the retarded condition, the oil under pressure is supplied to the retarded chambers 38*b* through the second passage 30 and the passages 56 by de-energizing the switching valve 111 and the angular phase of the inner rotor 22 (=the cam shaft 12) is retarded relative to that of the outer rotor 18 (=the crank shaft 70). In addition, the oil under pressure is also being filled in the receiving bore 48. Thus, even though the relative position between the inner rotor 22 and the outer rotor 18 becomes the maximum retarded condition an shown in FIG. 2, the filled oil in the receiving bore 48 and the filled oil in the damping chamber 58 prevent the entrance of the locking pin 44. In this condition, when the solenoid 112 of the switching valve 111 is energized, although the oil in the receiving hole 48 is discharged through the third passage 50 and the second passage 30, as mentioned above, the movement of the locking pin 44 toward the inner rotor 12 is damped by the above-mentioned damping effect of the damping chamber 58 and the small diameter portion 44*a* of the locking pin 44 is prevented from fitting into the receiving hole 48.

As mentioned above, in the above first embodiment, the opening and closing timing of the valves (not shown) driven by the cam shaft 12 is adjusted and the angular phase difference between the crank shaft 70 and the cam shaft 12 is adjusted. According to the first embodiment, since the damping chamber 58 in formed in the retracting hole 40 and the damping effect is efficiently obtained, while the engine is in rotation which drives the oil pump continually so that the supplied oil pressure from the oil pump via the switching valve 111 becomes high enough, the locking pin 44 is kept at its rest condition or immovable condition, which results in an increase in the life or durability of the locking pin 44 as well as in preventing unnecessary movement thereof. Further, the slight vibration of the locking pin due to the pulsation of the oil supplied to the receiving hole 48 is prevented by the damping effect and collision noise caused by the slight vibration of the locking pin is prevented.

In the first embodiment, the third passage 50 is communicated to the second passage 30. However, it is possible to communicate the third passage 50 to the first passage 28. Further, in the first embodiment, the receiving hole 48 is in alignment with the retracting hole 40 when the vane 52 minimizes the volume of the first pressure chamber 38*a* to which the oil under pressure is supplied during phase advance. However, the receiving hole 48 may be in alignment with the retracting hole 40 when the vane 52 minimizes the volume of the second pressure chamber 38*b* to which the oil under pressure is supplied during phase retard.

FIGS. 7 through 14 show a second embodiment of the present invention. In FIGS. 7 through 14, the same parts as compared with FIGS. 1 through 6 are identified by the same reference numerals. Referring to FIGS. 7 through 14, a cam shaft 210 which is provided with a plurality of cam portions (not shown) driving intake valves or exhaust valves (not shown) is rotatably supported on a cylinder head 310 of an engine at its plural journal portions. The cam shaft 210 comprises a rotation shaft of the present invention together with an inner rotor 220 which is fixed to an end of the cam shaft 210 is projected out of the cylinder head 310. The valve timing control device includes the rotation shaft and a rotation transmitting member comprising an outer rotor 30 and a timing pulley 260 which are rotatably mounted on the inner rotor 220. A rotational torque is transmitted from a crank shaft 320 via a timing belt 321 to the timing pulley 260 so that the timing pulley 260 is rotated clockwise in FIG. 8.

In the cam shaft 210, a first passage 211 and a second passage 212 which are extended in the axial direction are formed therein. The first passage 211 communicates with a connecting port 120 of a switching valve 111 via a radial passage 213, a circular groove 214 and a connecting passage 272. The second passage 212 communicates with a connecting port 121 of the switching valve 111 via a circular groove 215 and a connecting passage 274.

The switching valve 111 is constructed in such a manner that when a solenoid 112 is energized a spool 113 is moved against an urging force of a spring 114 in the rightward direction. While the spool 114 remains the illustrated condition which the solenoid 112 is not energized, the switching valve 111 establishes fluid communication between the connecting port 120 and a supply port 115 which communicates with the oil pump an well as establishes fluid communication between the connecting port 121 and a drain port 119. When the solenoid 112 is energized, the switching valve 111 establishes fluid communication between the connecting port 120 and a drain port 119 as well as establishes fluid communication between the connecting port 121 and the supply port 115. Thus, the oil is supplied to the first passage 211 while the solenoid 112 is not energized and the oil is supplied to the second passage 212 while the solenoid 113 is energized.

Figure 11:
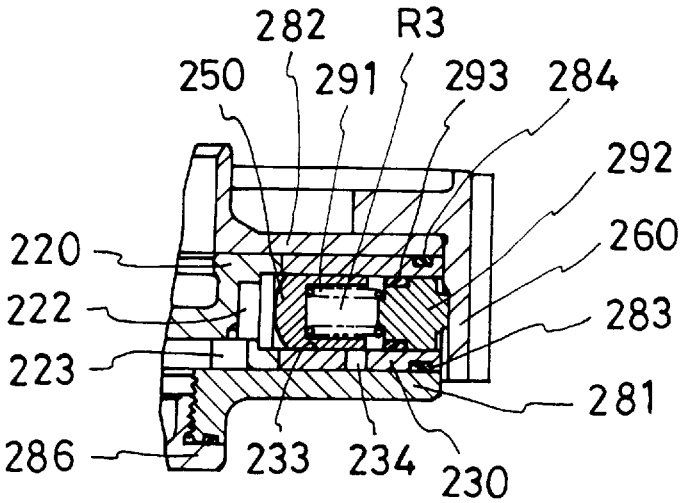
FIG. 11 shows a cross-sectional view taken on line C—C of FIG. 10.

The inner rotor 220 is fixedly mounted on the projecting end of the cam shaft 210 by a hollow bolt 219 so that the relative rotation between the rotor 220 and the cam shaft 210 is prevented. On the outer circumferential surface of the inner rotor 220, four axial grooves 221 in which four vanes 240 are mounted in the radial direction are formed thereon. Further, the inner rotor 220 in provided with a receiving hole 222 into which a head portion 251 of a locking pin 250 is fitted by a predetermined amount when the relative phase between the inner rotor 220 and the outer rotor 230 is in a predetermined phase, a third passage 223 for communicating between the receiving hole 222 and the first passage 211, passages 224 for communicating between the first passage 211 and first pressure chambers R1 (except for the first pressure chamber R1 located at the lower right side in FIG. 8) which are divided by the vanes 240 as described later and passages 225 for communicating between the second passage 212 and second pressure chambers R2 which are divided by the vanes 240. The first pressure chamber R1 which is located at the lower right side in FIG. 8 communicates with the receiving hole 222 via a passage 231 which is formed on an inner circumferential surface of the outer rotor 230. The receiving hole 222 has a stopped configuration and is provided with a large diameter portion at its radially outer end. The head portion 251 of the looking pin 250 is fitted into the large diameter portion of the receiving hole 222 and the apex of the head portion 251 is contacted with the stepped portion of the receiving hole 222. The outer end of the large diameter portion of the receiving hole 222 is chamfered as shown in FIG. 11. Each vanes 240 is urged outwardly in the radial direction by a spring 241 which is disposed on the bottom portion of the groove 221.

The outer rotor 230 is mounted on the outer circumference of the inner rotor 220 so as to be able to rotate with a predetermined amount relative to the inner rotor 220. Side plates 281 and 282 are fluid-tightly connected on both sides of the outer rotor 230 via seal members 283 and 284, and the side plates 281 and 282 and the outer rotor 230 are fastened by bolts 285 together with the timing pulley 260. A cap member 286 is fluid-tightly secured to the side plate 281 and thereby a passage 287 which communicates the first passage 11 to the passages 223 and 224 is formed. Further, concave portions 232 which define pressure chambers R0 together with the inner rotor 220 and the side plates 281 and 282 are formed on the inner circumference of the outer rotor 230. Each vanes 240 is disposed in each pressure chambers R0 and divides the pressure chamber R0 into the first pressure chamber R1 and the second pressure chamber R2. Further, a retracting hole 233 which penetrates in the radial direction and in which the locking pin 250 and a spring 291 urging the locking pin 250 toward the inner rotor 220 are disposed is formed in the outer rotor 230. The retracting hole 233 is in alignment with the receiving hole 222 when the relative phase between the inner rotor 220 and the outer rotor 230 is in the predetermined phase.

The retracting hole 233 is fluid-tightly blocked at its outer end by a plug 292 and a seal member 293 and an oil chamber R3 is formed between the plug 292 and the locking pin 250 in the retracting hole 233. The oil chamber R3 communicates with the second pressure chamber R2 via a passage 34 which is formed on the outer rotor 230. An opening of the passage 34 which is opened into the retracting hole 233 is positioned so that the opening is closed by a skirt portion 252 of the locking pin 250 when the locking pin 250 is moved against the urging force of the spring 291 by the oil under pressure supplied to the receiving hole 222 via the third passage 223. The plug 292 is prevented from coming out the retracting hole 233 by contacting with the inner circumference of the timing pulley 260.

The locking pin 250 is provided with the head portion 251 having a curved surface (a spherical surface) and the skirt portion 252. The skirt portion 252 is slidably fitted into the retracting hole 233 with a predetermined leaking clearance in the radial direction of the outer rotor 230 and the locking pin 250 in urged toward the inner rotor 220 by the spring 291. Thereby, the oil can be communicated via the leaking clearance between the skirt portion 252 and the retracting hole 233 and the oil can be communicated among the receiving hole 222, the fourth passage 234 and the oil chamber R3 even if the opening of the fourth passage 234 opened into the retracting hole 233 is closed by the skirt portion 251.

Figure 7:
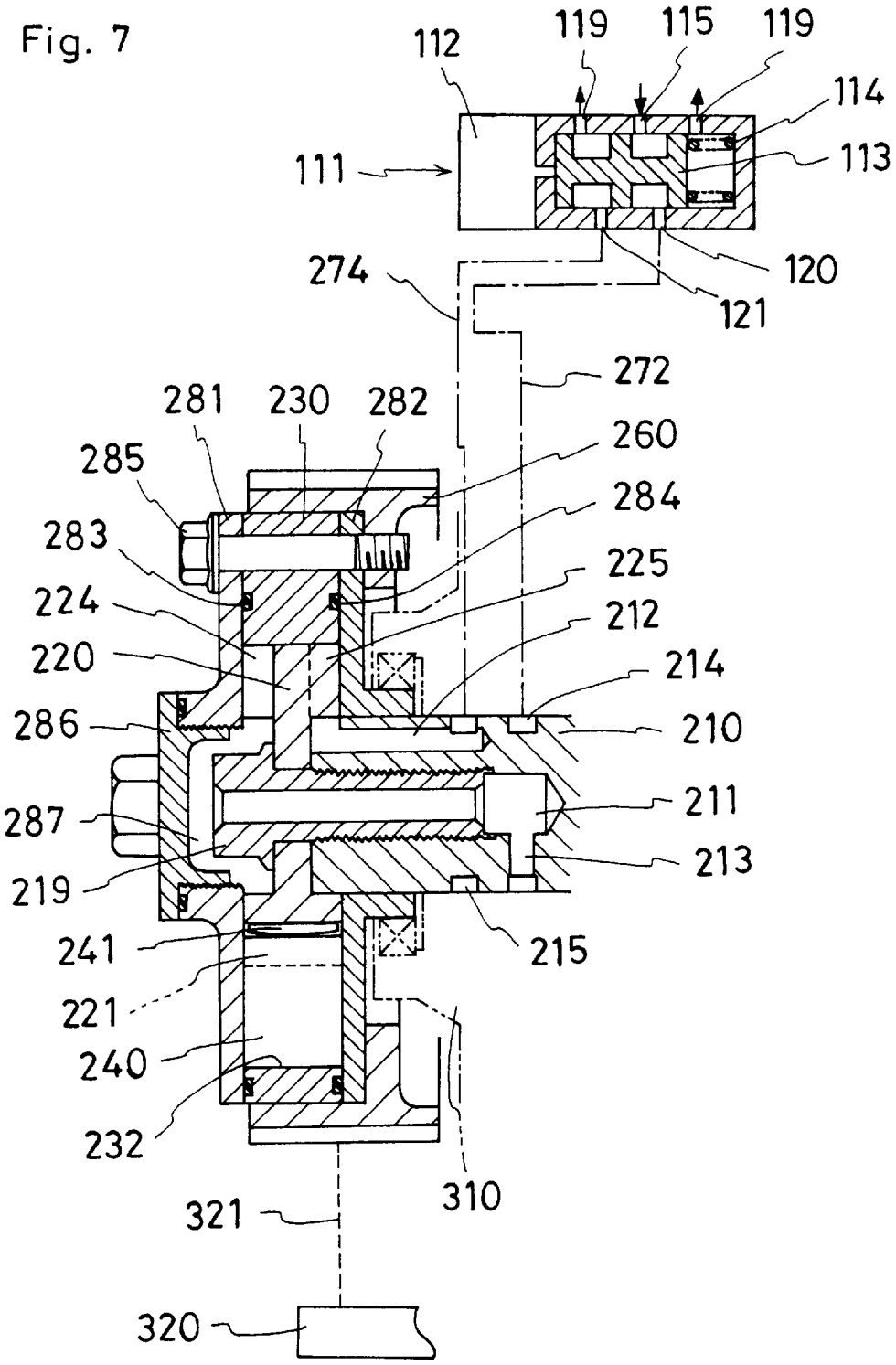
FIG. 7 shows a sectional view of a second embodiment of a valve timing control device in accordance with the present invention.
Figure 8:
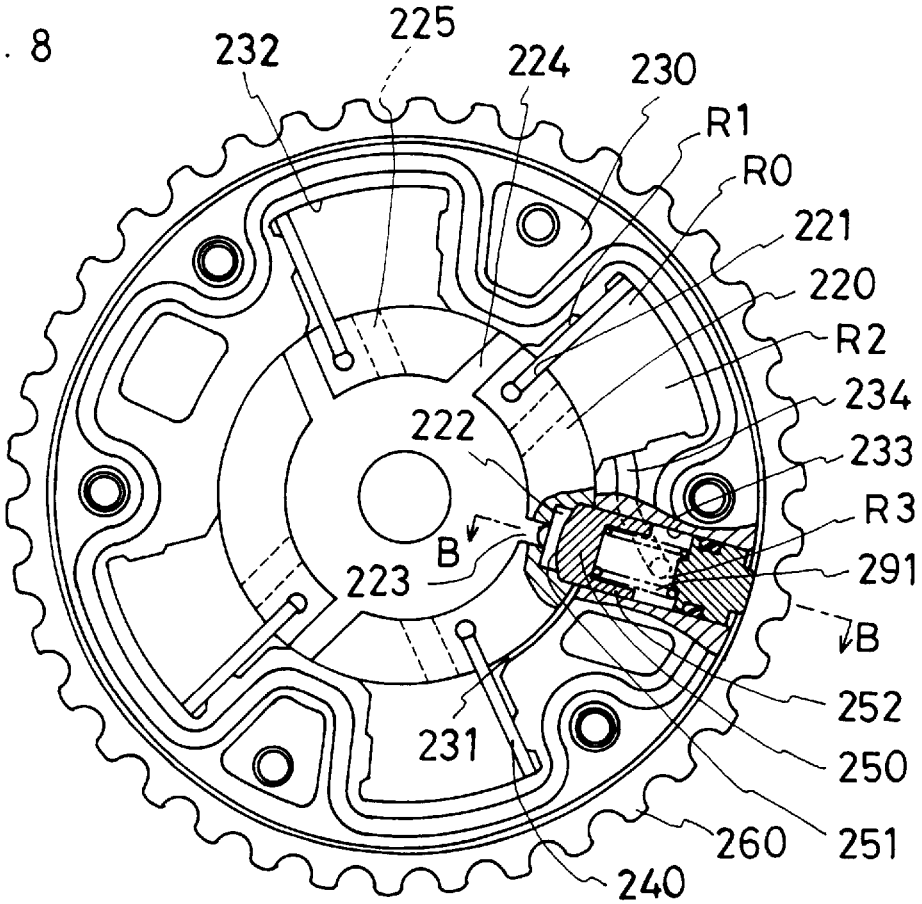
FIG. 8 is an elevation partly in section showing a relationship among an inner rotor, an outer rotor, vanes, a locking pin, a timing pulley and so on shown in FIG. 7.
Figure 9:
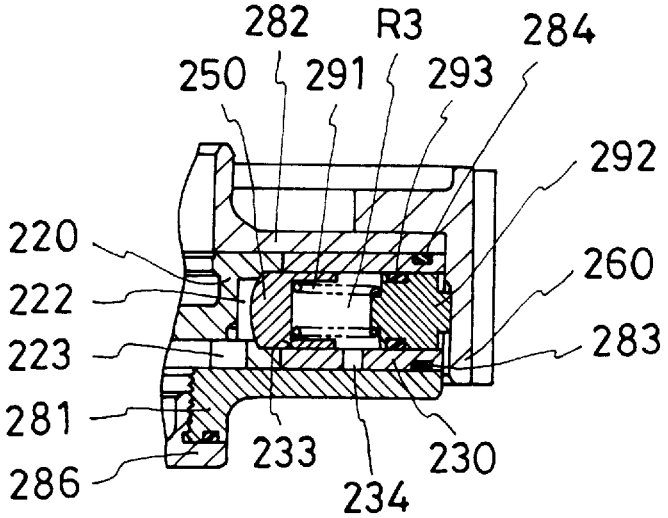
FIG. 9 shows a cross-sectional view taken on line B—B of FIG. 8.

In this second embodiment, while the engine is being at rest, the oil pump also remains non-operation and the switching valve 111 is in the condition shown in FIG. 7. Therefore, the receiving hole 222 is in alignment with the retracting hole 233 at the maximum retarded condition under which each of the vane 240 minimizes the volume of each first pressure chambers 38*a* and the head portion 251 of the locking pin 250 is fitted into the receiving hole 222 by the spring 291 as shown in FIGS. 8 and 9. Thereby, a relative rotation between the inner rotor 22 and the outer rotor 18 is prevented or locked. In this condition, when the engine is started and the oil pump is driven, and when the solenoid 112 of the switching valve 111 energized, the oil under pressure is not supplied to the first passage 211 of the cam shaft 210 from the switching valve 111 and the valve timing control device remains the locked condition shown in FIG. 8 and FIG. 9. Even though the insertion of the locking pin 250 into the receiving hole 222 is unsuccessful due to an out of phase between the receiving hole 222 and the retracting hole 233 when the engine is at rest, the desired insertion can be established. The reason is that the vane 240 begins to rotate toward the retarded phase angle side immediately when the engine starts, such a rotation completes while the oil pressure in each the pressure chambers R1 and R2 is at a low level, and as soon as the vane 240 takes the maximum retarded position, the receiving hole 222 and the retracting hole 233 become in phase.

Figure 10:
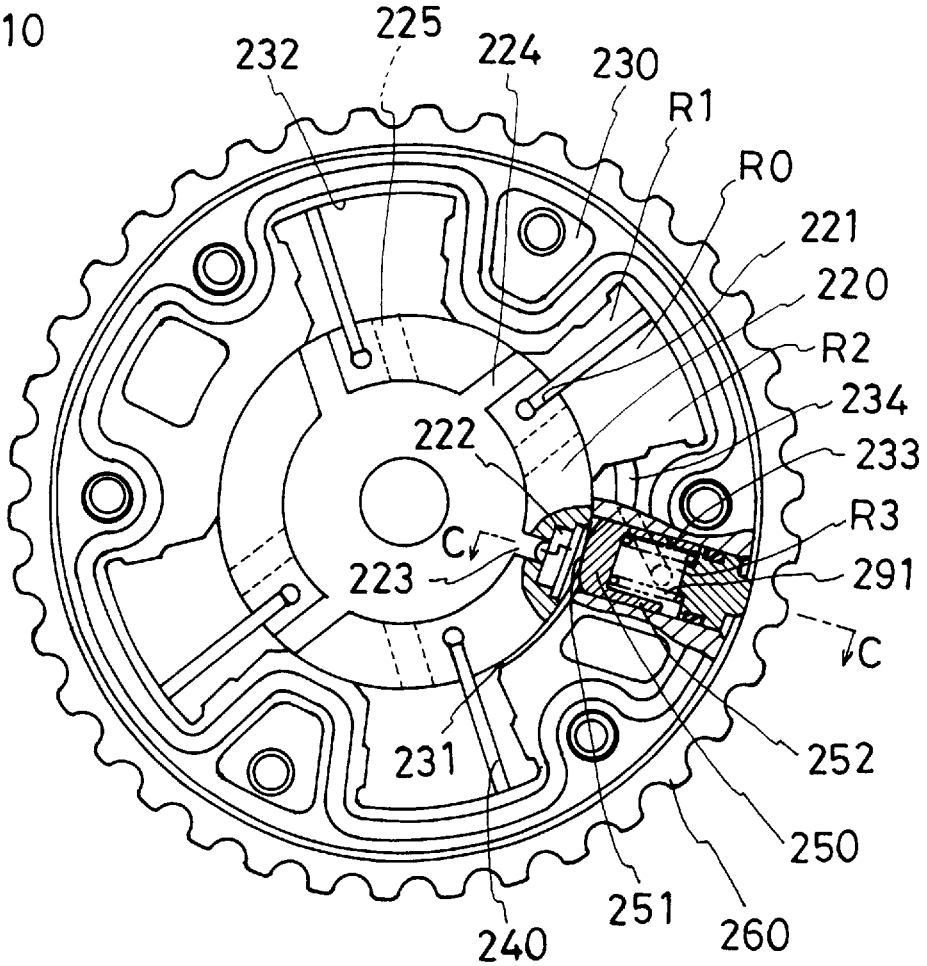
FIG. 10 is an elevation partly in section showing a condition which is advanced a little from the condition shown in FIG. 8.

While the engine is running and the oil pump is driven, when the solenoid 112 of the switching valve 111 is changed from the energized condition to the disenergized condition, the oil under pressure is supplied from the switching valve 111 to the first passage 211 of the cam shaft 210 and is further introduced to each first pressure chambers R1 via the passage 287 and each passages 224. At the same time, the oil under pressure is supplied from the passage 287 to the receiving hole 222. On the other hand, the oil is discharged from each second pressure chambers R2 via each passages 225, the second passage 212, the switching valve 111 and so on. Thereby, the locking pin 250 comes out the receiving hole 222 successively against the spring 291 by the oil under pressure which in supplied to the receiving hole 222 and the rotation shaft being comprised of the cam shaft 210, the inner rotor 220, the vanes 240 and so on is rotated relative to the rotation transmitting member be comprised of the outer rotor 230, the timing pulley 260 and so on as shown in FIGS. 10 and 11. The oil which is supplied to the receiving hole 222 is supplied to the first pressure chamber R1 located at the lower right side in FIG. 10 via the passage 231 formed an the outer rotor 230.

In the condition shown in FIGS. 10 and 11, namely in the condition under which the head portion 251 of the locking pin 250 which is a curved shape is partly fitted into the receiving hole 222, since the rotation shaft being comprised of the cam shaft 210, the inner rotor 220, the vanes 240 and so on is allowed to rotate relative to the rotational transmitting member be comprised of the outer rotor 230, the timing pulley 260 and so on, the rotation shaft begins to rotate relative to the rotation transmitting member before whole of the head portion 251 of the locking pin 250 comes out the receiving hole 222. Accordingly, it is able to shorten a time until the rotational shaft begins to rotate relative to the rotational transmitting member after the oil under pressure begins to be supplied to the receiving hole 222 and therefore the response of the operation of the valve timing control device in improved.

Figure 12:
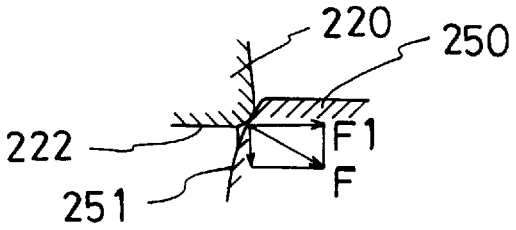
FIG. 12 shows an enlarged view of a principal portion.
Figure 13:
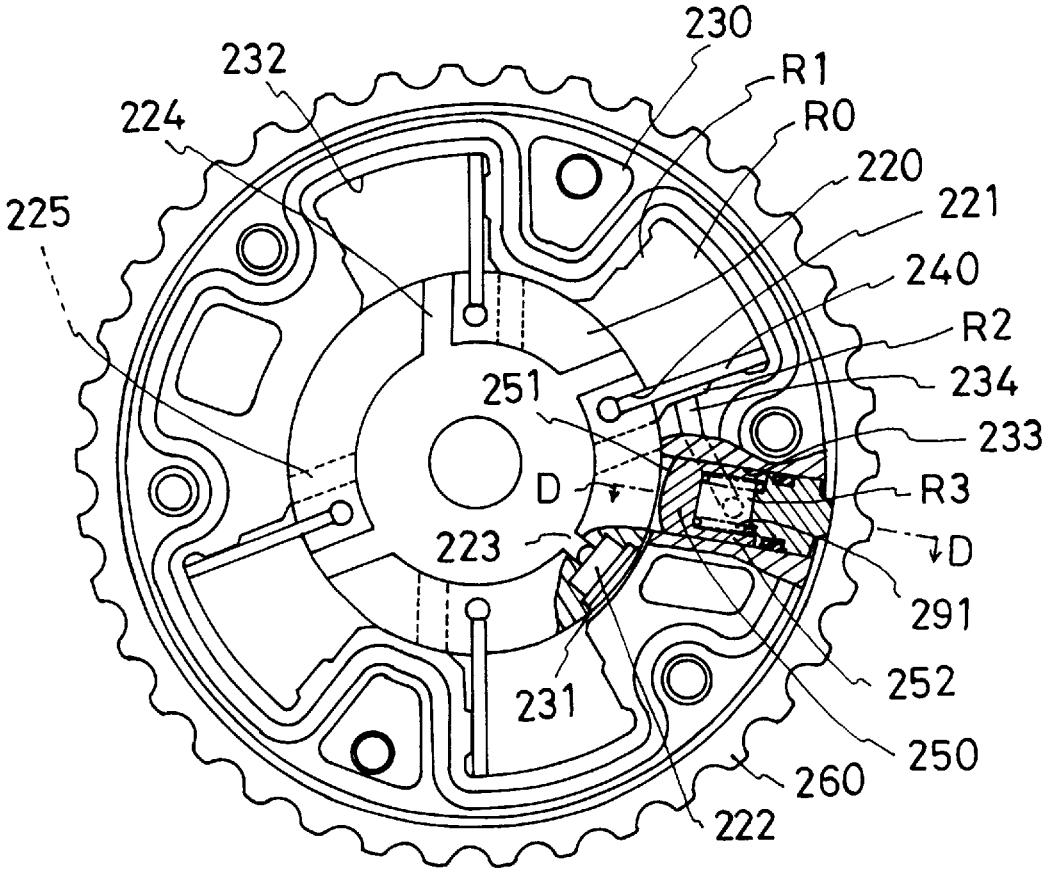
FIG. 13 is an elevation partly in section showing a condition which is advanced from the condition shown in FIG. 10.
Figure 14:
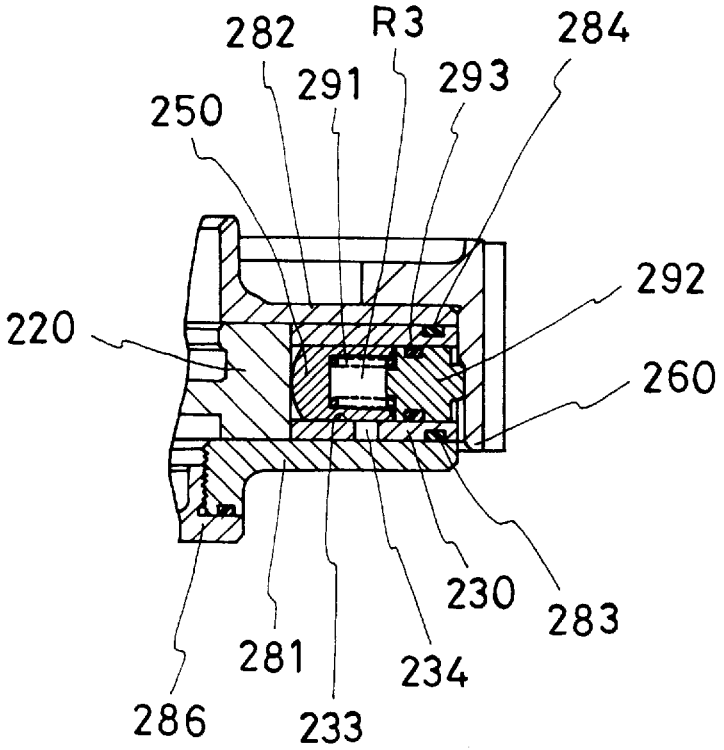
FIG. 14 shows a cross-sectional view taken on line D—D of FIG. 13.
Figure 15:
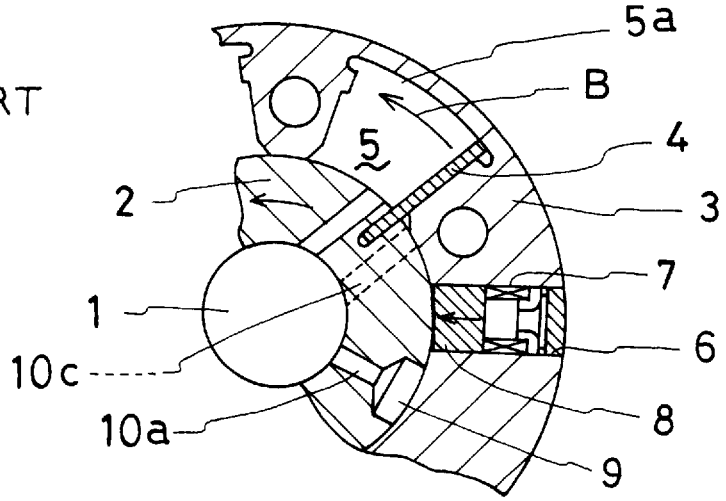
Fig. 15 (A) PRIOR ART
FIG. 15A shows a cross-sectional view of a conventional valve timing control device at a maximum advanced condition.
FIG. 15B shows a cross-sectional view of a conventional valve timing control device at a maximum retarded condition.
FIG. 15C shows a cross-sectional view of a conventional valve timing control device when a rotor is in the course of an advance movement.
Figure 15:
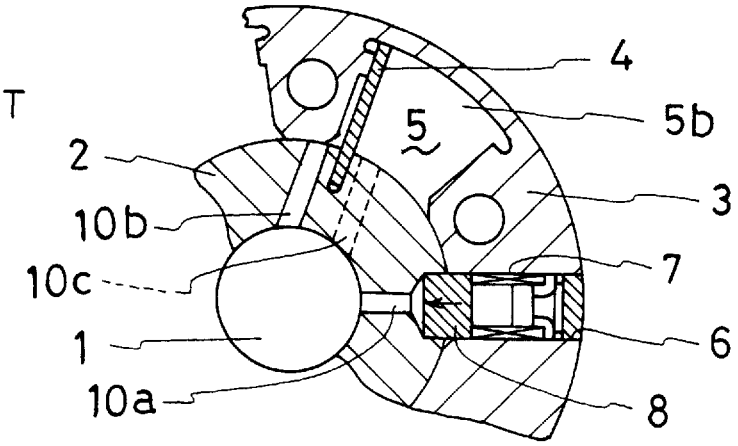
Fig. 15 (B) PRIOR ART
Figure 15:
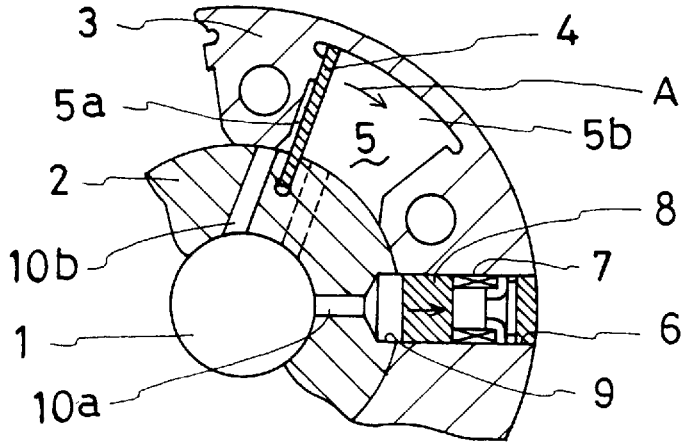
Fig. 15 (C) PRIOR ART

Further, in the condition shown in FIGS. 10 and 11, since the locking pin 250 is pushed outwardly by not only the oil supplied to the receiving hole 222 but also by a component force F1 of the force which acts on the locking pin 250 by the relative rotation between the rotation shaft and the rotation transmitting member an shown in FIG. 12, the locking pin 250 comes out the receiving hole 22 rapidly. Accordingly, it is able to rapidly change from the condition (the maximum retarded condition) shown in FIGS. 8 and 9 to the condition (the maximum advanced condition) shown in FIGS. 13 and 14 via the condition shown in FIGS. 10 and 11. As shown in FIGS. 13 and 14, the vanes 240 minimize the volume of the second pressure chambers 38*a* at the maximum advanced condition.

When the rotational shaft is rotated relative to the rotational transmitting member from the condition shown in FIGS. 8 and 9 to the condition shown in FIGS. 13 and 14 via the condition shown in FIGS. 10 and 11, the pulsation of the oil supplied to the receiving hole 222 acts on the locking pin 250. In this second embodiment, since the retracting hole 233 is communicated to the second pressure chamber R2 via the fourth passage 234 and thereby the locking pin 250 receive a damping effect, when the rotational shaft rotates relative to the rotational transmitting member under the condition which the locking pin 250 comes out the receiving hole 222 by the oil supplied to the receiving hole 222, the slight vibration of the locking pin 250 due to the pulsation of the oil supplied to the receiving hole 222 is prevented, and collision noise caused by the slight vibration of the locking pin 250 is prevented. Particularly, according to the second embodiment, since the opening of the fourth passage 234 opened into the retracting hole 233 is closed by the skirt portion 252 of the locking pin 250 when the locking pin 250 comes out the receiving hole 222 and the fluid communication between the oil chamber R3 and the fourth passage 234 is restricted, the above damping effect is efficiently obtained and the slight vibration of the locking pin 250 is efficiently prevented.

In the condition shown in FIGS. 13 and 14, when the solenoid 112 of the switching valve 111 is changed from disenergized condition to the energized condition, the oil under pressure is supplied from the switching valve 111 to the second passage 212 of the cam shaft 210 and is further supplied to each second pressure chambers R2 via each passages 225. On the other hand, the oil is discharged from each first pressure chambers R1 via each passages 224 or the passage 231, the receiving hole 222, the third passage 223, the first passage 211, the switching valve 111 and so on. Thereby, the rotation shaft being comprised of the cam shaft 210, the inner rotor 220, the vanes 240 and so on is rotated relative to the rotation transmitting member being comprised of the outer rotor 230, the timing pulley 260 and so on and the relative position between the rotational shaft and the rotational transmitting member is changed from the condition shown in FIGS. 13 and 14 to the condition shown in FIGS. 8 and 9. At this time, since the opening of the fourth passage 234 opened into the retracting hole 233 is closed by the skirt portion 252 of the locking pin 250 and the fluid communication between the oil chamber R3 and the fourth passage 234 is restricted, even though the receiving hole 222 is in alignment with the retracting hole 233, the locking pin 250 in prevented from fitting into the receiving hole 222 by the damping affect.

As mentioned above, according to the second embodiment, the opening and closing timing of the valves (not shown) driven by the cam shaft 210 is adjusted and the angular phase difference between the crank shaft 320 and the cam shaft 210 is adjusted. According to the second embodiment, since the damping effect due to the restricted fluid communicating between the oil chamber R3 and the fourth passage 234 is obtained when the receiving hole 222 is in alignment with the retracting hole 233, the number of the operation of the locking pin 250 is remarkably reduced and thereby the durability and the reliability of the locking mechanism is remarkably improved.

In the second embodiment, the receiving hole 222 is in alignment with the retracting hole 233 when the vane 240 minimizes the volume of the first pressure chamber R1 to which the oil under pressure is supplied during phase advance. However, the receiving hole 222 may be in alignment with the retracting hole 233 when the vane 240 minimizes the volume of the second pressure chamber R2 to which the oil under pressure is supplied during phase retard. Further, in the second embodiment, the third passage 223 communicates the passages 224 communicated to the first pressure chambers R1 and the fourth passage 234 communicates to the second pressure chamber R2 adjacent to the retracting hole 233. However, the third passage 223 may be communicated to the passages 225 communicated to the second pressure chambers R2 and the fourth passage 234 may be communicated to the first pressure chamber R1 adjacent to the retracting hole 233.

Further, in the above first and second embodiments, the vanes are connected to the inner rotor and the locking pin and the spring are disposed in the outer rotor. However, the vanes are connected to the outer rotor and the locking pin and the spring are disposed in the inner rotor.

The principles, preferred embodiments and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A valve timing control device comprising:

a rotational shaft for opening and closing a valve;

a rotational transmitting member rotatably mounted on the rotational shaft;

a vane connected to one of the rotational shaft and the rotational transmitting member;

a chamber defined between the rotational shaft and the rotational transmitting member and divided into a first pressure chamber and a second pressure chamber by the vane being extended into the chamber;

fluid supply means for supplying fluid under pressure to at least a selected one of the first pressure chamber and the second pressure chamber;

locking means for connecting the rotational shaft and the rotational transmitting member when the relative phase between the rotational shaft and the rotational transmitting member is in a predetermined phase; and damping means for damping the locking operation of the locking means.

2. A valve timing control device recited in claim 1, wherein the fluid supplying means includes first passage for supplying fluid under pressure into the first pressure chamber and the second fluid passage for supplying fluid under pressure into the second pressure chamber, and wherein the locking means includes a retracting hole which is formed on one of the rotational shaft and the rotational transmitting member and in which a locking pin is urged toward the other of the rotational shaft and the rotational transmitting member, a receiving hole which is formed on the other of the rotational shaft and the rotational transmitting member and in which the locking pin is fitted when the relative phase between the rotational shaft and the rotational transmitting member is in said predetermined phase and a third passage for supplying fluid under pressure into the receiving hole.

3. A valve timing control device recited in claim 2, wherein the retracting hole has a stepped configuration and the locking pin is provided with a large diameter portion and a small diameter portion which are slidably fitted in the retracting hole and the small diameter portion of the locking pin can be fitted into the receiving hole at the predetermined phase, and wherein the damping means includes a damping chamber which is formed between a stepped portion of the retracting hole and a stepped portion of the locking pin.

4. A valve timing control device recited in claim 3, wherein at least one passage is formed on a sliding portion between the small diameter portion of the locking pin and the retracting hole so as to communicate between the receiving hole and the damping chamber.

5. A valve timing control device recited in claim 4, wherein the passage is a slit which is formed on the outer circumferential portion of the small diameter portion of the locking pin.

6. A valve timing control device recited in claim 5, wherein the slit is formed on the outer circumferential portion at a distal end of the small diameter portion of the locking pin.

7. A valve timing control device recited in claim 2, wherein the predetermined phase is a phase which the vane minimizes the volume of the second pressure chamber to which the oil under pressure is supplied via the second passage during phase retard, and wherein the second passage is communicated to the third passage in the rotation shaft.

8. A valve timing control device recited in claim 3, wherein an elastic member is disposed on at least one of the stepped portion of the locking pin and a back surface of the locking pin.

9. A valve timing control device recited in claim 2, wherein the third passage communicates with one of the first pressure chamber and the second pressure chamber, and the retracting hole communicates with the other of the first pressure chamber and the second pressure chamber via a fourth passage.

10. A valve timing control device recited in claim 3, wherein one end of the retracting hole is blocked and the locking pin is able to projected from the other and of the retracting hole, and wherein the fourth passage is opened into a fluid chamber formed between the locking pin and one end of the retracting hole and the opening of the fourth passage is closed by the locking pin when the locking pin comes out the receiving hole.

* * * * *